US010533368B1

(12) United States Patent
White

(10) Patent No.: US 10,533,368 B1
(45) Date of Patent: Jan. 14, 2020

(54) DOOR COVER SYSTEM AND METHOD OF USE

(71) Applicant: David White, Abilene, TX (US)

(72) Inventor: David White, Abilene, TX (US)

( * ) Notice: Subject to any disclaimer, the term of this patent is extended or adjusted under 35 U.S.C. 154(b) by 0 days.

(21) Appl. No.: 15/274,686

(22) Filed: Sep. 23, 2016

(51) Int. Cl.

| | |
|---|---|
| ***E06B 3/30*** | (2006.01) |
| ***E06B 3/673*** | (2006.01) |
| ***E06B 3/70*** | (2006.01) |
| ***E06B 7/28*** | (2006.01) |

(52) U.S. Cl.
CPC ..... *E06B 3/7001* (2013.01); *E06B 7/28* (2013.01); *E06B 3/30* (2013.01); *E06B 3/673* (2013.01); *E06B 3/67356* (2013.01)

(58) Field of Classification Search
CPC ..... E06B 3/30; E06B 3/673; E06B 3/67339; E06B 3/67356; E06B 3/7001; E06B 7/28; E06B 9/00
USPC ..... 52/783.1, 784.1, 784.12, 784.13
See application file for complete search history.

(56) References Cited

U.S. PATENT DOCUMENTS 2,833,004 A * 5/1958 Johnson ..... E06B 3/88 428/73
4,327,535 A * 5/1982 Governale ..... E06B 3/5892 49/501
4,544,440 A * 10/1985 Wheeler ..... B32B 21/10 216/29
4,552,797 A * 11/1985 Munk ..... B27N 5/00 428/167
4,749,601 A * 6/1988 Hillinger ..... B32B 3/12 428/116
5,417,024 A * 5/1995 San Paolo ..... E06B 5/16 52/455
5,483,386 A * 1/1996 Carson ..... A47G 1/02 359/879
5,720,142 A * 2/1998 Morrison ..... E04C 2/292 52/309.14
5,839,252 A * 11/1998 Berghorn ..... E06B 3/822 52/475.1
6,024,908 A * 2/2000 Koncelik ..... B29C 43/003 264/331.11
6,098,368 A * 8/2000 McKann ..... E04C 2/292 52/784.13
6,132,540 A * 10/2000 Barber ..... E06B 3/7001 156/242
6,311,454 B1 * 11/2001 Kempel ..... E06B 3/76 52/309.11
6,694,702 B2 * 2/2004 Weymer ..... B23K 26/26 52/309.15
7,854,102 B2 * 12/2010 Zappa ..... B66B 13/30 49/501

(Continued)

*Primary Examiner* — Phi D A
(74) *Attorney, Agent, or Firm* — Eldredge Law Firm

(57) ABSTRACT

A door cover system and method of use for a door having a front surface. The system includes a cover body; an embossing on the front surface of the cover body; a ledge protruding from the back surface of the cover body and configured to engage with a top surface of the door; and a fastener secured to the back surface of the cover body and configured to secure the cover body to the front surface of the door. The method includes removably securing the cover body to the front surface of the door; outlining cut patterns on the cover body; removing the cover body from the front surface of the door; cutting the cut patterns; and rigidly securing the cover body to the front surface of the door via a fastener.

1 Claim, 3 Drawing Sheets

(56) References Cited

U.S. PATENT DOCUMENTS

| | | | | |
|---|---|---|---|---|
| 7,895,806 | B2 * | 3/2011 | Avila | E04C 2/292 52/588.1 |
| 8,136,327 | B1 * | 3/2012 | Sokol | E06B 3/822 52/455 |
| 2001/0026862 | A1 * | 10/2001 | Smith | B27N 5/00 428/174 |
| 2003/0115817 | A1 * | 6/2003 | Blackwell | E06B 7/086 52/456 |
| 2003/0140587 | A1 * | 7/2003 | Smith | E06B 3/725 52/455 |
| 2003/0145542 | A1 * | 8/2003 | Chen | E06B 3/825 52/309.9 |
| 2008/0163585 | A1 * | 7/2008 | Wang Chen | E06B 3/7001 52/784.1 |
| 2014/0260080 | A1 * | 9/2014 | Swartzmiller | E06B 3/72 52/784.1 |

* cited by examiner

DOOR COVER SYSTEM AND METHOD OF USE

BACKGROUND

1. Field of the Invention

The present invention relates generally to doors, and more specifically, to a door system and method of use.

2. Description of Related Art

Doors are well known in the art and are effective means to allow a party to enter and exit a room. The doors also serve as a cosmetic feature of a room and are manufactured with different contoured and/or embossed surfaces. For example, FIG. 1 depicts a front view of a door 101 having aesthetically pleasing features, e.g., a plurality of decorative panels on the front surface.

In the exemplary embodiment, door 101 has a body 103 with two parallel sides 105 and 107 that extends from a top side 109 to a bottom side 111. A plurality of hinges is secured to side 107 and provide pivoting means as the door opens and closes. The front surface 113 includes one or more panels 117 that provide decorative means for aesthetic appearances. The door 101 is further provided with a handle 119 used to manipulate a latch 121.

One of the problems commonly associated with door 101 is the limited aesthetic appearance. For example, it is common to replace the door when the party dislikes the panel arrangement. There is no other easy and rapid means to change the panels in the art.

Accordingly, although great strides have been made in the area of doors, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
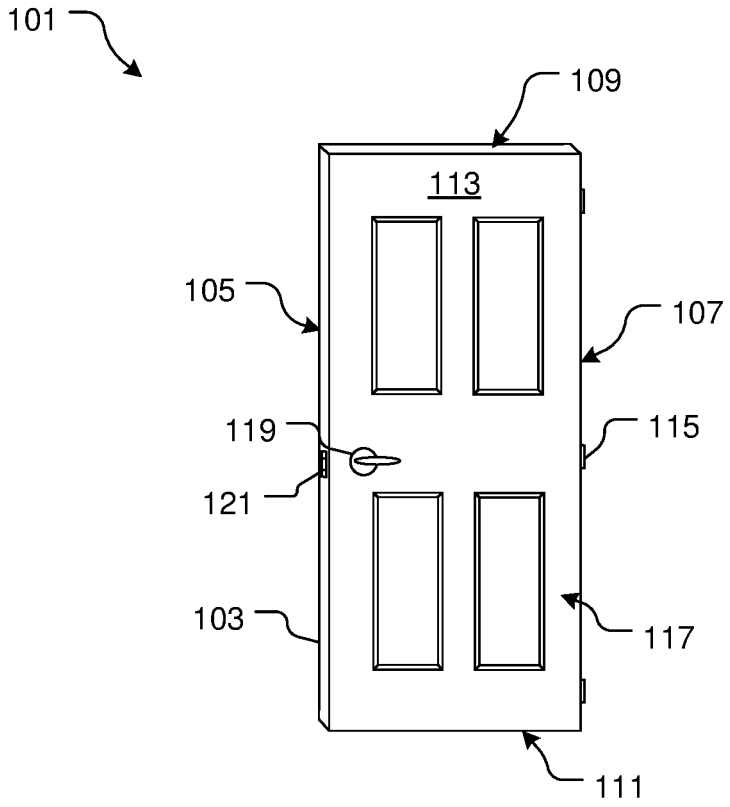
FIG. 1 (Prior Art)
FIG. 1 is a front view of a conventional door.
Figure 2:
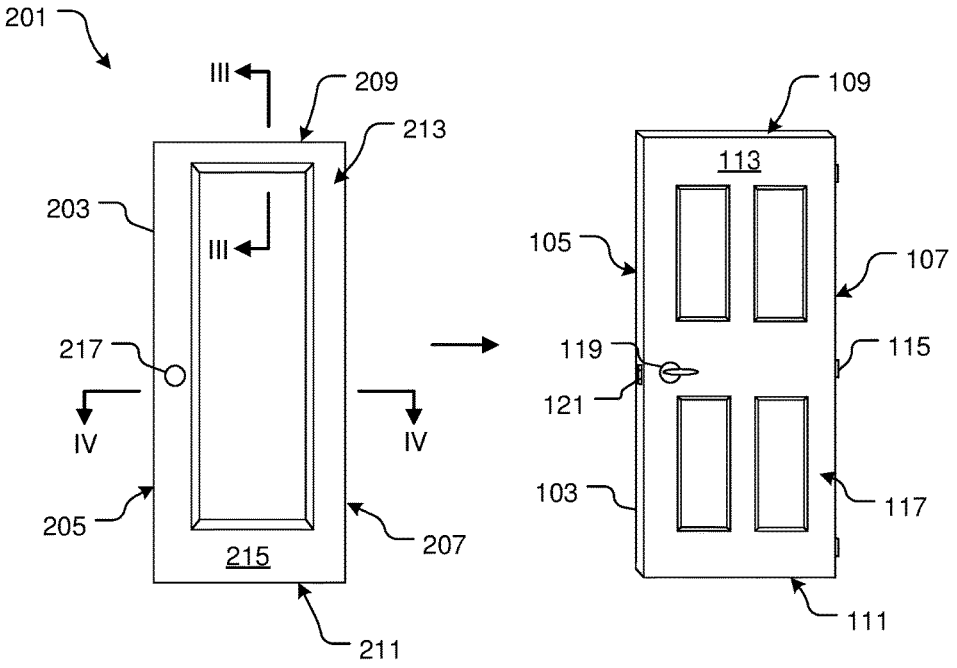
FIG. 2 is a front view of a system and method of use in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 2-6 depict various views of a system 201 and method of use in accordance with a preferred embodiment of the present application. It will be appreciated that system 201 overcomes one or more of the above-listed problems commonly associated with the conventional doors.

In the contemplated embodiment, system 201 is utilized with a conventional door 101 as will be discussed in depth below. Accordingly, it will be appreciated that system is configured to retrofit existing doors and to change the aesthetic appearances thereof. To achieve this feature, system 201 is provided with a rigid cover body 203 extending from opposing ends 205, 207 and extending from opposing ends 209, 211. The cover body 203 includes one or more panels 213 and/or other aesthetic features on surface 215.

Figure 5:
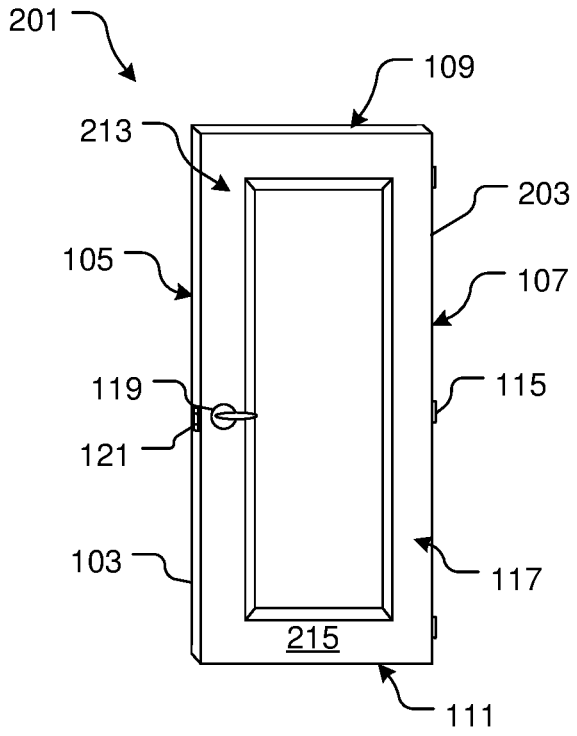
FIG. 5 is a front assembled view of the system of FIG. 2.

As shown in FIG. 5, the cover body 203 extends completely over front surface 113 and changes the appearance of the door. Accordingly, the system 201 provides effective means to change the aesthetic appearance of the door without the need for replacement. The system is easily and rapidly secured to the front surface 113 of door 101, as will be discussed more fully below.

Figure 3:
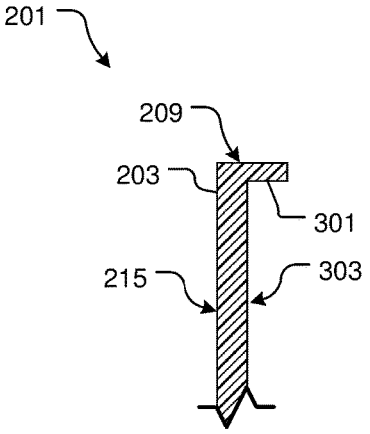
FIG. 3 is cross-sectional view of the cover taken at III-III of FIG. 2.

In FIG. 3, a cross-sectional view of the cover body 203 is shown. In the preferred embodiment a ledge 301 protrudes from a back surface 303 of the cover body 203 and is configured to engage with the top surface 109 of the door body 103. This feature allows the user to hang the cover body 203 to the door, which in turn enables the user to make cutting outlines for the exact width, length, and openings 217 for later cutting. After the cuts are made, the cover body is adhered to the front surface of 113 via an adhesive 401 secured to back surface 303, as depicted in FIG. 4.

Figure 4:
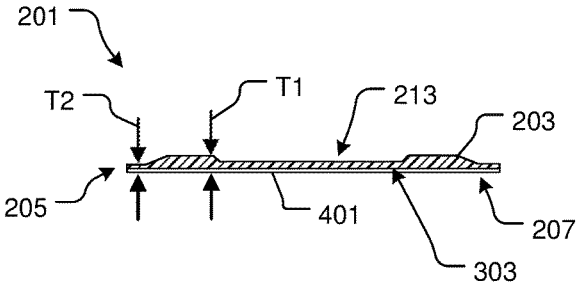
FIG. 4 is cross-sectional view of the cover taken at III-III of FIG. 2.

As depicted in FIG. 4, it should be appreciated that the edges taper downwardly from the center of the cover body. The cover body has a thickness "T1" greater than the thickness "T2" of the edges. This feature allows the edges to fit snugly within the points of contact between the door structure (not shown) and the edges of the door. Without this feature, the cover body would prevent the door from closing.

Figure 6:
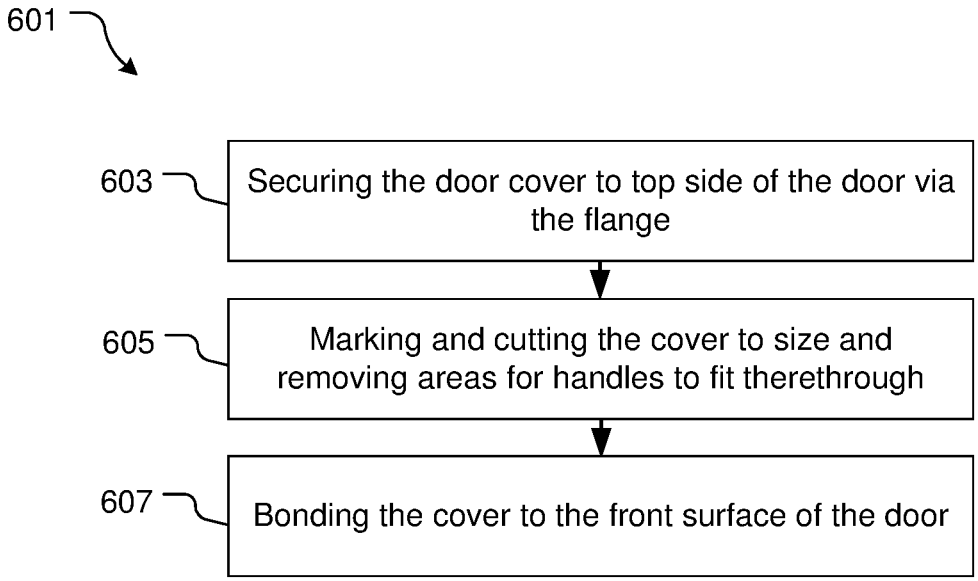
FIG. 6 is a flowchart depicting the preferred process.

FIG. 5 is a front view of the system being secured to the door, while FIG. 6 is a flowchart 601 of the preferred method of assembly. The assembly steps include securing the door cover body to the door via the flange, as depicted in box 603. Then the door cover body is marked, cut, and then bonded to the front surface of the door, as depicted with boxes 605 and 607. In the preferred embodiment, the bonding process is achieved via an adhesive with a liner used over the adhesive and removed prior to use; however, other fastening devices are also contemplated, e.g., a magnet, clip, snap, hook-loop fastener, and the like.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A method to change an appearance of a front surface of a rectangular door, comprising:

providing a door cover having:

a rectangular cover body having a first side end extending to a second side end; and a top end extending to a bottom end;

a ledge integral with the top end and extending therefrom at an angle;

a front surface and a back surface, the front surface extending from the first side end to the second side end and from the top end to the bottom end;

a first body portion extending from the first side end and having a first thickness;

a second body portion integral with the first body portion and having a second thickness, the second thickness being greater than the first thickness, the second thickness is greater in length than the first thickness, the body having a transition thickness that tappers from the second thickness to the first thickness and the first thickness being adjacent to the first side;

wherein the front surface tappers from the second body portion to the first body portion; and an embossing on the front surface of the cover body; and an adhesive secured to the back surface of the rectangular cover body;

securing a rectangular door within a door structure;

changing the appearance of the front surface of the rectangular door by retrofitting the rectangular door with the rectangular cover body, the rectangular door remaining secured within the door structure during the changing of appearance;

removably securing the rectangular cover body to the front surface of the rectangular door, via the ledge, the ledge engaging with a top surface of the door;

outlining a cut pattern on the rectangular cover body for a door handle;

removing the rectangular cover body from the front surface of the door;

cutting the cut pattern;

rigidly securing the rectangular cover body to the front surface of the rectangular door via the adhesive such that the first body portion is adjacent to a side edge of the door; and extending the door handle through an opening created by the cut pattern; and closing the rectangular door and the rectangular cover body such that the first body portion secures between the front surface and the door structure, such that the first body portion does not obstruct closing of the rectangular door against the door structure.

* * * * *